US007347223B2

(12) United States Patent
Richter

(10) Patent No.: US 7,347,223 B2
(45) Date of Patent: Mar. 25, 2008

(54) PIPE FLOW STABILIZER

(75) Inventor: James R. Richter, Lincolnshire, IL (US)

(73) Assignee: The Metraflex Company, Chicago, IL (US)

( * ) Notice: Subject to any disclaimer, the term of this patent is extended or adjusted under 35 U.S.C. 154(b) by 228 days.

(21) Appl. No.: 10/624,033

(22) Filed: Jul. 21, 2003

(65) Prior Publication Data

US 2005/0017019 A1 Jan. 27, 2005

(51) Int. Cl.
*F15D 1/04* (2006.01)

(52) U.S. Cl. ..... 138/37; 138/39; 138/118; 222/547; 222/564

(58) Field of Classification Search ..... 138/37, 138/39, 44, 118; 222/564, 547; 366/336, 366/340, 339
See application file for complete search history.

(56) References Cited

U.S. PATENT DOCUMENTS 2,420,715 A * 5/1947 Millward ..... 138/116
2,478,998 A * 8/1949 Fisher et al. ..... 239/461
2,688,985 A * 9/1954 Holdenried ..... 138/37
2,929,248 A 3/1960 Sprenkle
2,975,635 A * 3/1961 Kindler et al. ..... 73/861.02
3,029,094 A * 4/1962 Parlasca et al. ..... 285/114
3,049,009 A * 8/1962 McCall et al. ..... 73/861.92
3,113,593 A 12/1963 Vicard
3,126,125 A * 3/1964 Eggers ..... 221/96
3,645,298 A * 2/1972 Roberts et al. ..... 138/40
3,840,051 A 10/1974 Akashi et al.
3,841,568 A * 10/1974 Broad ..... 239/590
3,854,637 A * 12/1974 Muller et al. ..... 222/564
3,945,402 A * 3/1976 Murphy ..... 138/37
3,946,650 A 3/1976 Culpepper, Jr.
4,142,413 A * 3/1979 Bellinga ..... 73/198
4,154,265 A * 5/1979 Holsomback ..... 138/41
4,248,099 A * 2/1981 Allen et al. ..... 73/861.353
4,365,932 A * 12/1982 Arnaudeau ..... 415/199.5
4,366,746 A * 1/1983 Rosecrans ..... 91/467
RE31,258 E 5/1983 De Baun
4,408,892 A * 10/1983 Combes et al. ..... 366/337
4,420,016 A * 12/1983 Nichols ..... 138/103
4,459,861 A * 7/1984 Hoffmann ..... 73/861.78
5,197,509 A 3/1993 Cheng
5,273,321 A * 12/1993 Richter ..... 285/92
5,307,830 A 5/1994 Welker
5,309,946 A 5/1994 Ligneul
5,323,661 A 6/1994 Cheng
5,363,699 A * 11/1994 McCall ..... 73/198
5,482,249 A * 1/1996 Schafbuch et al. ..... 251/118

(Continued)

*Primary Examiner*—John Rivell
*Assistant Examiner*—Craig Price
(74) *Attorney, Agent, or Firm*—Greer, Burns & Crain, Ltd.

(57) ABSTRACT

A fluid flow stabilizer for use in a flow of fluid in a conduit between a source of turbulence and a fluid control device. The stabilizer comprises a fluid conduit section having a first end with a mounting arrangement for mounting the first end to the fluid conduit and a second end with a mounting arrangement for mounting the second end to the fluid conduit, the fluid conduit section having a fluid passage therethrough to allow fluid to flow from the first end to the second end, and a flow straightening device positioned in the fluid conduit section. The fluid conduit section may be constructed to absorb at least one of shock, vibration and alignment in the conduit.

23 Claims, 4 Drawing Sheets

U.S. PATENT DOCUMENTS 5,495,872 A * 3/1996 Gallagher et al. ..... 138/44
5,588,635 A * 12/1996 Hartman ..... 251/127
5,596,152 A * 1/1997 Bergervoet et al. ..... 73/861.83
5,623,103 A * 4/1997 Francisco, Jr. ..... 73/861.352
5,762,107 A 6/1998 Laws
5,937,908 A * 8/1999 Inoshiri et al. ..... 138/39
6,012,492 A * 1/2000 Kozyuk ..... 138/37
6,014,987 A * 1/2000 List et al. ..... 137/549
6,035,897 A * 3/2000 Kozyuk ..... 138/37
6,065,498 A 5/2000 Campau
6,145,544 A 11/2000 Dutertre et al.
6,186,179 B1 * 2/2001 Hill ..... 138/39
6,289,934 B1 * 9/2001 Welker ..... 138/39
6,619,331 B1 * 9/2003 Suchdev ..... 138/177
6,701,963 B1 * 3/2004 Hill ..... 138/39

* cited by examiner

PIPE FLOW STABILIZER

FIELD OF THE INVENTION

The present invention relates to flow stabilizers and more particularly to flow stabilizers for use in pipes.

BACKGROUND OF THE INVENTION

A known characteristic of fluid flow, such as the flow of liquid in a pipe, is the turbulence of the flow. Turbulence in a pipeline can be created by bends in the pipe run, connections with other pipes, partially opened valves, constrictions in the pipe, as well as moving mechanical devices such as the moving elements of a pump such as a pump rotor, diaphragm, vanes, etc.

Frictional losses and other problems develop as a result of turbulent flow, which problems disappear or diminish as flow becomes more laminar. There are known devices used to reduce turbulence in a fluid flow such as the flow straightening devices shown in U.S. Pat. Nos. Re. 31,258; 3,946,650; 2,929,248; 3,113,593; 3,840,051; 5,307,830; 5,309,946; 5,495,872; 5,762,107; 6,065,498; and 6,145,544.

Devices such as those disclosed in U.S. Pat. Nos. 5,197,509 and 5,323,661 are known to eliminate or reduce elbow induced turbulence in pipe flows, being positioned upstream of the elbow. These devices actually change a straight flowing stream and impart a rotation to them about the flow axis and upstream of the elbow.

In certain pipe line configurations, fluid control devices such as valves are provided in the pipe line downstream from a pump or other turbulence causing structure such as a pipe elbow. For example, the valve may be a check valve to prevent the reverse flow of fluid when the pump is not operating, the valve may be used to completely pinch off the pipeline to stop the flow of fluid, without shutting off the pump, the valve may be used to throttle the fluid flow through the pipe downstream of the pump as a way of fine tuning or balancing the flow volume to meet different requirements, even though the pump might normally provide a greater flow volume than is desired. Some valves combine two or all three of these features.

When valves of these types are used downstream of a pump, it is standard and customary practice to space the valve 5 to 10 pipe diameters downstream of the pump. This is necessary to allow the turbulence created by the pump to subside, to allow the flow to become more laminar, so that operation of the pump is not hampered, such as excessive forces being applied to a partially closed valve. In situations where the pipe diameter is large, this requires a significant pipe run between the pump and the valve. For example, in the case of a 10 inch diameter pipe, the valve should be spaced 50 to 100 inches from the pump. Oftentimes the space for this length of pipe run is not available.

Therefore, it would be an improvement in the art if a device or arrangement were provided to allow for a shorter pipe length to extend between a pump or other source of turbulence in a fluid flow and a valve or other fluid control device that is negatively affected by turbulent flow.

SUMMARY OF THE INVENTION

The present invention provides a device or arrangement to allow for a shorter pipe length to extend between a pump or other source of turbulence in a fluid flow and a valve or other fluid control device that is negatively affected by turbulent flow.

A connecting segment of pipe is provided with a flow straightening device which significantly reduces the required length of pipe between the source of the turbulence, such as a pump, and the fluid control device, such as a valve. The connecting segment may be provided with other features, such as shock or vibration absorption, misalignment compensation, or fastener conversion elements.

These and other features and advantages of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention provides a device arranged to stabilize a fluid flow in an enclosed space, such as in a pipe line or other fluid conduit. Although the present invention is not limited only to pipelines, as an illustrative embodiment of the invention, it is shown in such an arrangement.

Figure 1:
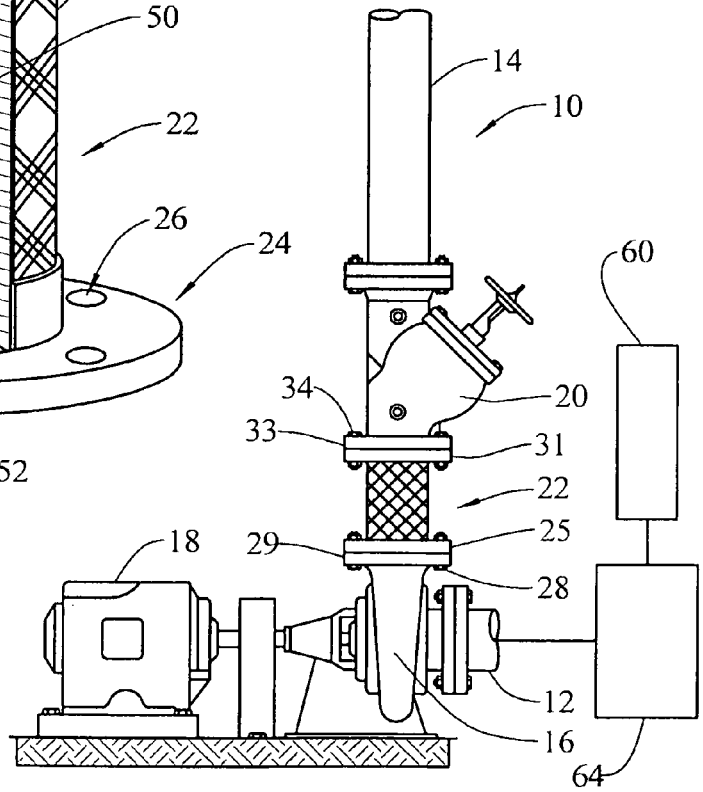
FIG. 1 is a side elevational view of a pipeline incorporating a flow stabilizer embodying the principles of the present invention.

In FIG. 1 a conduit in the form of a pipeline is illustrated generally at 10 and includes an upstream pipe portion 12 and a downstream pipe portion 14 arranged for carrying fluids in the downstream direction and interposed between the two pipe sections are a series of elements which act on the fluid flow. Specifically, a turbulence creating device, such as a pump 16 which may be driven by a motor 18 is used to draw in fluid from the inlet pipe section 12 and to drive that fluid toward the downstream pipe section 14. As a result of the action of the pump, which may incorporate moving internal components such as vanes, rotors, diaphragms, etc. as is well known in the art, turbulence is created in the fluid flow as the flow leaves the pump. Other types of turbulence creating devices in pipelines are well known and include bends or elbows in the pipe, changes in the pipe diameter, partially open valves or other flow restrictors, inlets or outlets to other pipes, and rough pipe interiors.

A fluid control device 20 in the form of a valve is positioned downstream of the pump 16 and may be used to control various features of the fluid flow as the fluid moves into the downstream pipe section 14. For example, the valve 20 may be a check valve which would prevent the reverse flow of fluid from the downstream pipe section 14 toward the inlet pipe section 12 in the event that the pump 16 stops operating. The valve 20 may be used to completely pinch off the flow of fluid from the inlet pipe section 12 to the outlet pipe section 14, even though the pump 16 may continue to operate. Further, the valve 20 may be used to throttle or balance the fluid flow from the inlet pipe section 12 to the downstream pipe section 14 so as to control the flow volume through the downstream pipe section 14, particularly in those instances where the pump 16 operates on a constant and fixed output level. The valve 20 may be able to supply one, two or all three of these different functions.

The proper operation of the fluid control device 20 is hampered when the fluid flow therethrough is turbulent. Specifically, back checking may be ineffective when a back check valve is placed in an area of turbulent fluid flow, precise control of the volume of fluid flow may not be achievable when a flow control valve is placed in a turbulent area and even the operation of a pinch off valve may be negatively affected if such a valve is placed in an area of turbulent flow. For these reasons, it has been necessary in the past to supply a straight length of pipe between a turbulence creating device, such as a pump, and a flow control device, such as a valve, with the length of straight pipe being on the order of five to ten pipe diameters. The present invention provides a flow stabilizing device 22 which can be inserted between the source of turbulence, such as the pump 16, and the flow control device 20 and has a length shorter than five to ten times the diameter of the pipe, to thereby reduce the spatial displacement requirement between the pump 16 and valve 20, in this case, which is particularly useful in situations where the pipe diameter is large.

Figure 3:
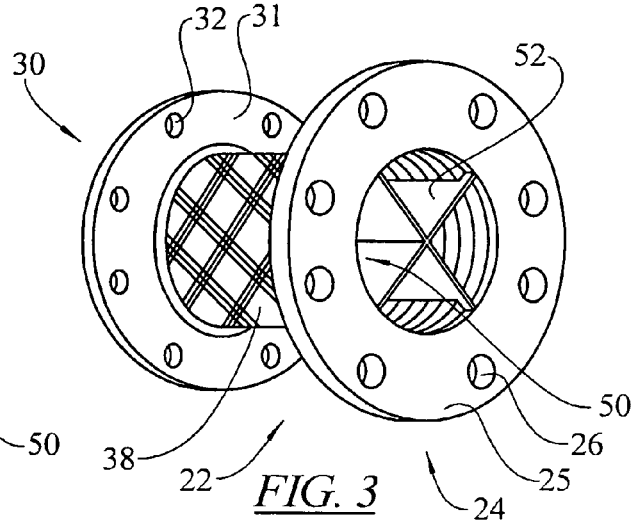
FIG. 3 is an end perspective view of the flow stabilizer.
Figure 2:
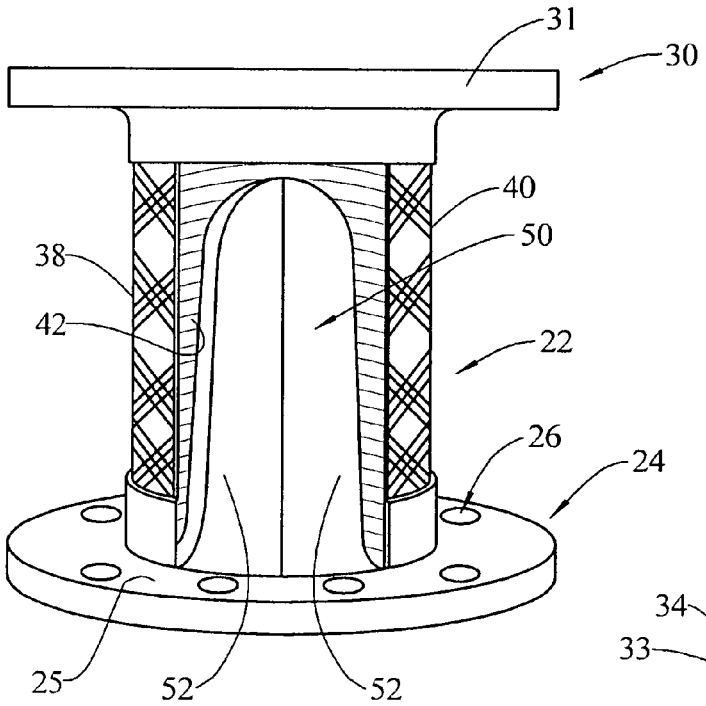
FIG. 2 is a side elevational view partially cut away of the flow stabilizer.

An embodiment of the pipe flow stabilizer of the present invention is illustrated in more detail in FIGS. 2 and 3.

The pipe flow stabilizer 22 has a first end 24 which includes a first mounting arrangement 26 for mounting the first end to a portion of the pipeline, for example, directly to the pump. In the embodiment illustrated, the first end 24 comprises a flange 25 and the first mounting arrangement 26 comprises holes formed in the flange to receive through bolts 28 (FIG. 1) which can extend through a similar flange 29 on the pump 16. Appropriate gaskets may be utilized between the pump flange 29 and the pipe flow stabilizer flange 25 to effect a fluid tight seal therebetween.

The pipe flow stabilizer 22 has a second end 30 with a second mounting arrangement 32 for mounting the second end to the pipeline, for example, directly to the valve 20. In the illustrated embodiment, the second end 30 may also comprise a flange 31 which mates directly to a flange 33 of the valve 20 and the mounting arrangement comprises a series of bolt holes 32 to receive through bolts 34 (FIG. 1) to clamp the two flanges together. Again, appropriate gaskets or other materials may be utilized to effect a fluid tight seal between the two flanges.

Figure 2A:
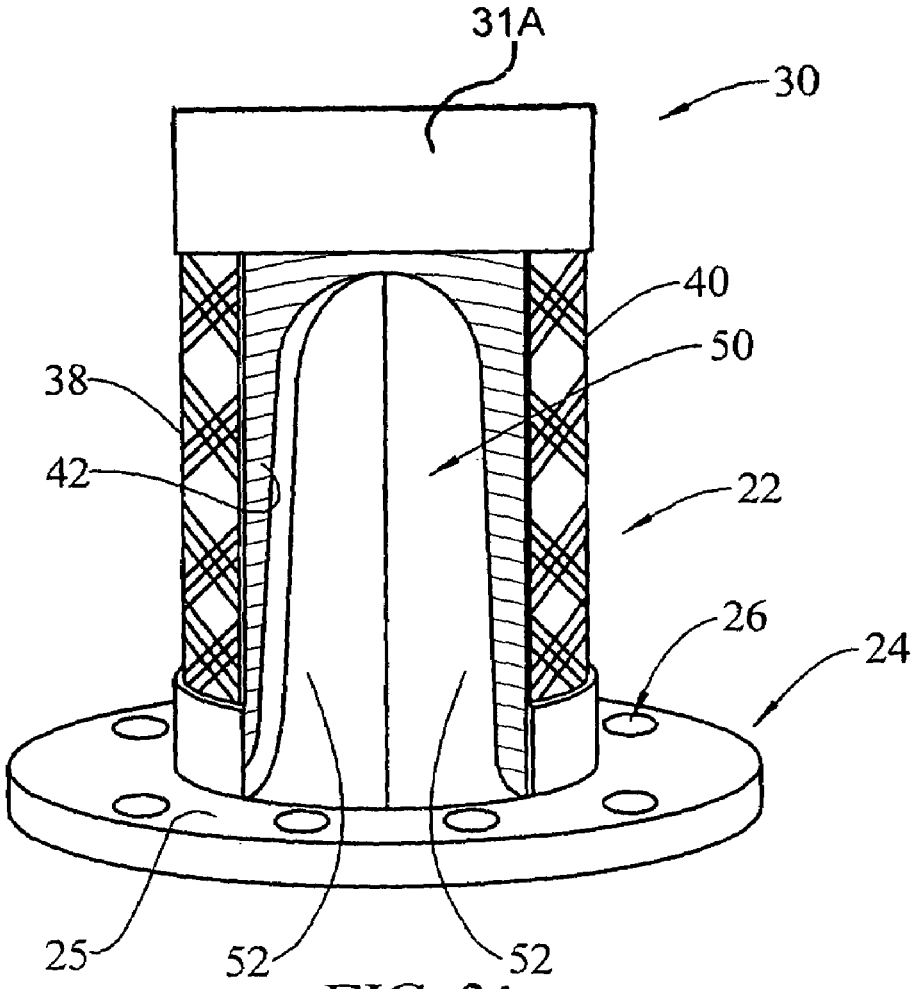
FIG. 2A is a side elevational view partially cut away of a modified flow stabilizer, including one flange connection and one mounting arrangement which may be a flange, a male or female threaded portion, a slip fit or a compression fitting.

In other pipeline arrangements different types of mounting arrangements may be provided including male or female threaded portions, slip fit arrangements to be soldered or welded together, compression fittings and other well known fluid conduit connection arrangements, such as shown in FIG. 2A, where 31A represents any of the various mounting arrangements, and the other reference numbers are the same as those used in the other figures. A different mounting arrangement may be provided at the first end 24 as opposed to the second end 30 to accommodate different connection needs for various components of the pipeline system, thus allowing the pipe flow stabilizer 22 to also function as a fastener conversion element where different components of the pipeline require different types of fastening or mounting arrangements.

Interposed between the first end 24 and the second end 30 is a conduit section 38 which is designed to contain the fluid flowing through the pipeline. Depending upon the fluid, the conduit section 38 may be required to be constructed of different materials, particularly where the fluid is corrosive or abrasive. The conduit section 38 may also be fabricated in a way to be able to absorb or dampen shock, vibration or mis-alignment in the pipeline system. For example, the walls of the conduit section 38 may be formed of a flexible and resilient material while still maintaining integrity to prevent leakage of the fluid contained therein. In the embodiment illustrated in FIGS. 2 and 3, the conduit section 38 is formed of a flexible metal hose commonly available in the industry which has an external metal braided layer 40 and internal corrugated pipe layer 42. Such a construction will permit and absorb axial and radial movements between the first end 24 and the second end 30 so that such movements are not transmitted along the pipeline, or are greatly reduced, while imparting no thrust load to the remainder of the pipeline.

Other types of absorbing conduit may be utilized, for example the flexible connector disclosed in U.S. Pat. No. 5,273,321 and incorporated herein by reference, could be utilized for the conduit section.

Internal of the flow stabilizer 22 is a flow straightening device 50 which is used to straighten and stabilize the fluid flow, causing the fluid flow to transition from a turbulent flow towards a laminar flow. The flow straightening device may comprise a plurality of vanes 52 extending longitudinally in the fluid conduit. For example, in the embodiment illustrated, the flow straightening device 50 comprises four vanes 52, with each vane arranged perpendicular to adjacent vanes. The vanes 52 may extend along a portion of the distance between the first end 24 and second end 30, that is, they may be of a length less than, equal to, or greater than the distance between the first end and second end. Also, the vanes may extend across the full internal diameter of the fluid conduit 38 or they may be shaped in a manner wherein they do not occupy the entire internal diameter of the fluid conduit. For example, as illustrated in FIG. 2, the vanes are provided with a hydrodynamic shape, that is, a shape which further assists in the transition from turbulent flow towards laminar flow such that the edges of the vanes are formed of soft or gentle curves without abrupt changes in direction. This shape assists in stabilizing the fluid flow and helps to prevent vortex shedding and other turbulent events. This shape also allow for lateral or radial movement of the second end 30 without causing the vanes to contact the inside layer 42 of the conduit section 38. Other configurations of flow straighteners, including a plurality of thin walled pipe lengths, screens, perforated plates and other arrangements, such as disclosed in U.S. Pat. No. 5,495,872 and incorporated herein by reference, could be utilized.

Figure 4:
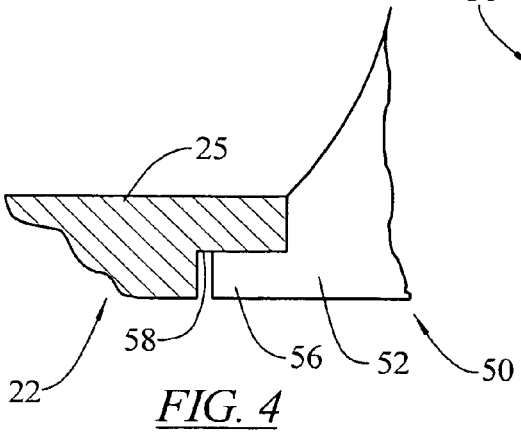
FIG. 4 is a partial side sectional view of a valve mounting arrangement.

An arrangement for mounting the flow straightening device 50 to the pipe flow stabilizer 22 as illustrated in FIG. 4. In this embodiment, the flow straightening device 50 comprises a flange 52 which has an enlarged foot portion 56. The foot portion 56 is captured in a recess 58 formed in the first end flange 25. The vane 52 could be welded, epoxied or secured in some other fashion to the flange 25 if it is desired to secure the two components together. Otherwise, the vane structure 52 could be loosely captured in the fluid conduit 38 with the foot 56 engaged by the recess 58 of the flange 25 to prevent downstream movement of the vanes 52. However, in most situations, due to the turbulence at the first end 24, it is preferred to secure the flow straightening device 50 to the remainder of the pipe flow stabilizer 22.

As a further enhancement to the invention, or as a separate element, a device 60 may be provided to reduce or eliminate at the turbulence at the turbulence creating device, such as an elbow 64 or other discontinuity in the pipeline. For example, in the pipeline illustrated in FIG. 1, often times the upstream pipe section 12 comprises an elbow 64 (shown schematically) leading directly into the pump 16. If the flow of liquid into the pump 16 is turbulent, then the operation of the pump is less efficient and in some cases, damage to the pump could result. In these situation, it would be beneficial to introduce a turbulence reducing device 60 (shown schematically in FIG. 1), such as those disclosed in U.S. Pat. Nos. 5,197,509 and 5,323,661, and incorporated herein by reference, upstream of the turbulence creating device to reduce or eliminate any turbulence that might otherwise be created.

Figure 5:
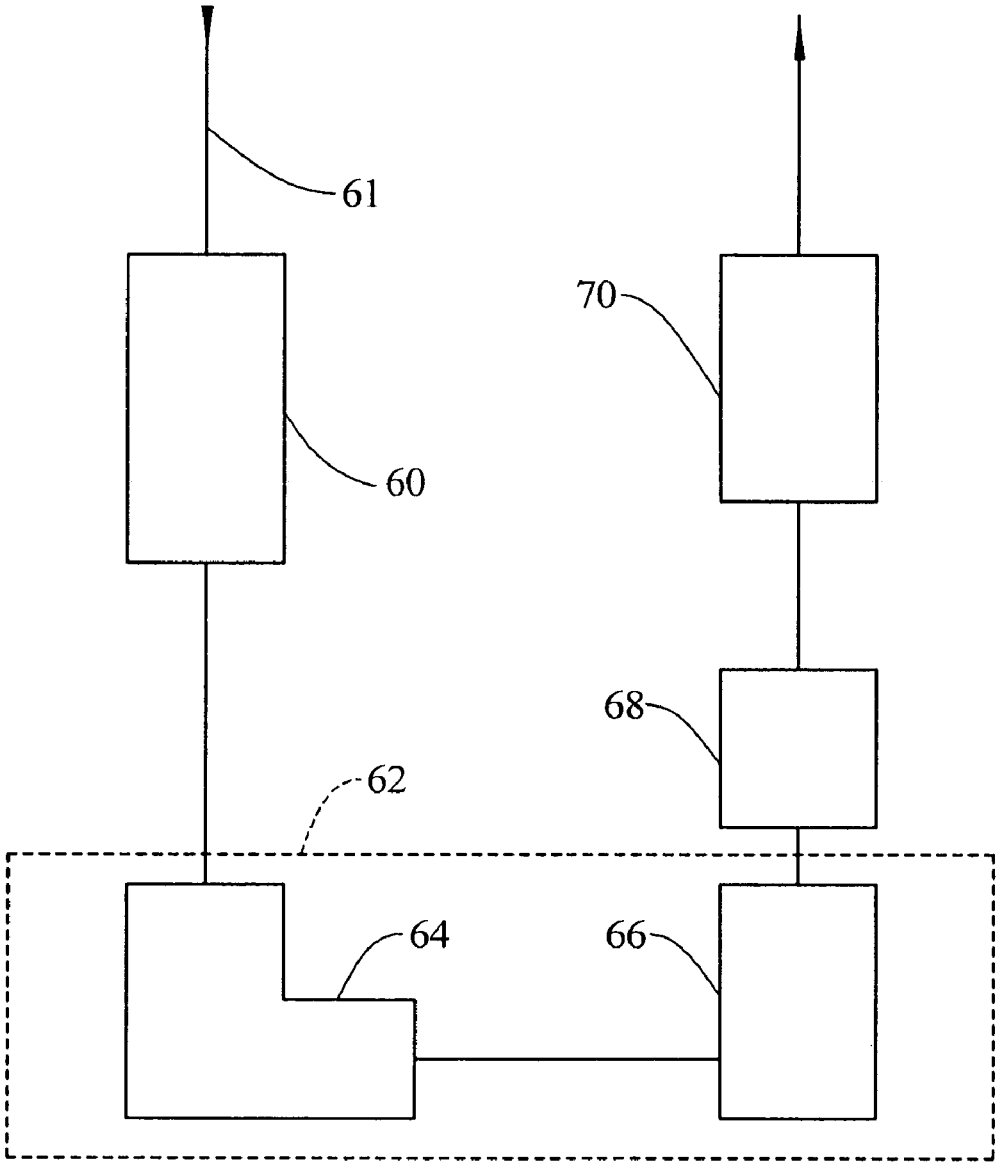
FIG. 5 is a schematic illustration of a pipeline with a turbulence reducing system embodying the principles of the present invention.

As shown in a schematic illustration in FIG. 5, when a turbulence reducing device 60 is used in a pipeline 61 with a flow straightening device incorporating the principles of the present invention, the flow would first encounter the turbulence reducing device 60, then a turbulence creating device 62, such as an elbow 64 or pump 66, or the combination of an elbow and a pump, and then the flow would encounter a flow straightening device 68 and finally the fluid control device 70, such as a valve. In situations where no fluid control device is positioned closely following the turbulence creating device 62, the flow straightening device may be omitted. Thus, for example, where an elbow closely precedes a pump, the turbulence reducing device 60 would still be of value and benefit by conditioning the flow entering the pump.

Figure 6:
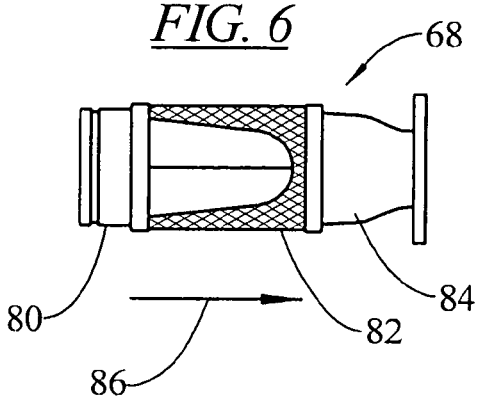
FIG. 6 is a side elevational view of another embodiment of the flow stabilizer.

The flow straightening device 68 of FIG. 5 could be a flow straightening device as shown at 22 in FIGS. 1-4, or could be provided in other embodiments and with other attachments, such as shown in FIGS. 6-9. In FIG. 6, the flow straightening device 68 is comprised of a first connection end 80, a flow straightening portion 82 and a reducer connection 84 with the flow through the straightening device being in the direction of arrow 86. The connection end 80, as illustrated comprises a groove connection for mating to another piping section with an appropriate connector, as is known. The connection end could also have a flanged connection as shown in FIGS. 2 and 3, or other types of connections, such as threaded ends or flush ends for attachment by welding or soldering.

Figure 7:
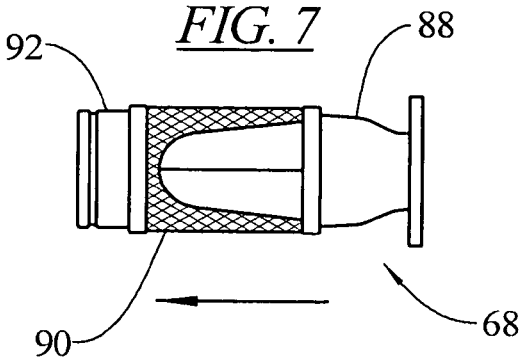
FIG. 7 is a side elevational view of another embodiment of the flow stabilizer.
Figure 8:
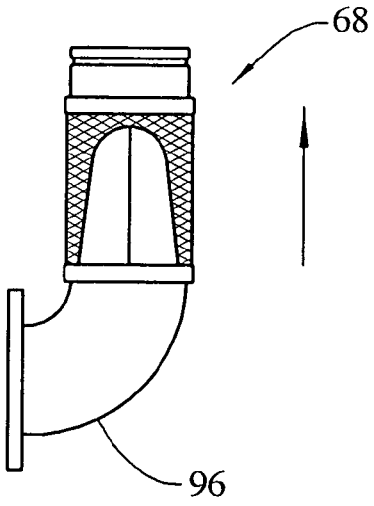
FIG. 8 is a side elevational view of another embodiment of the flow stabilizer.
Figure 9:
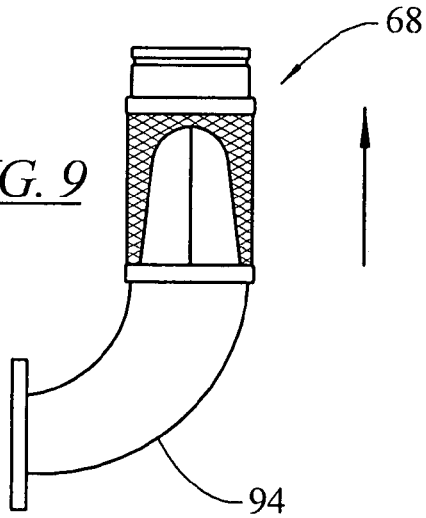
FIG. 9 is a side elevational view of another embodiment of the flow stabilizer.

The order of the parts could also be reversed as illustrated in FIG. 7 showing flow first through a reducer 88, then a flow straightening portion 90 and finally through a connection end 92. The reducer 88 could be replaced with a reducer/elbow 94 as shown in FIG. 9, or a straight, non-reducer elbow 96 as shown in FIG. 8. For each of these embodiments, the connection portion, at either the connection end or at the reducer or elbow, could be a flanged connection, a groove connection, a threaded connection or a weld/solder connection. As described above, the fluid conduit section having a length of less than five times the diameter, refers to the flow straightening portion, and not to the elbows, reducers or connection extensions that may be formed integrally or attached to the flow straightening portion. The elbows, connections and reducers, if provided, are considered to be a portion of the pipeline conduit rather than the fluid conduit section that provides the flow straightening, even though these parts may be formed integrally with or come preattached to the fluid conduit section.

Figure 10:
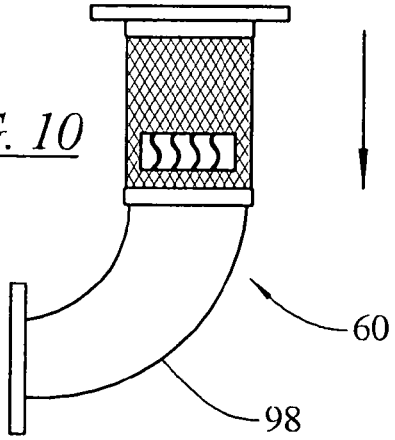
FIG. 10 is a side elevational view of an embodiment of the turbulence reducing device.
Figure 11:
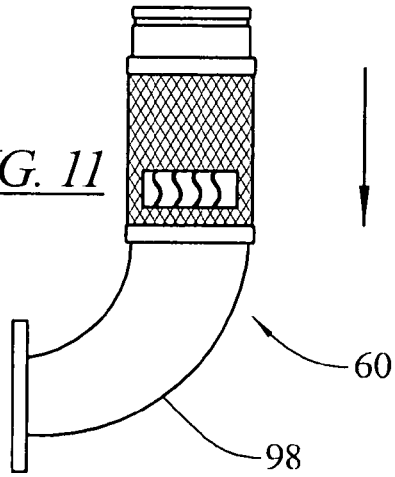
FIG. 11 is a side elevational view of another embodiment of the flow stabilizer.

The turbulence reducing device 60 could also be provided with attachments such as a reducing elbow 98 as shown in FIGS. 10 and 11, and may be provided with a flange end 100 (FIG. 10), a groove end 102 (FIG. 11), a threaded end or a weld/solder end.

The present invention has been described utilizing particular embodiments. As will be evident to those skilled in the art, changes and modifications may be made to the disclosed embodiments and yet fall within the scope of the present invention. The disclosed embodiments are provided only to illustrate aspects of the present invention and not in any way to limit the scope and coverage of the invention. The scope of the invention is therefore only to be limited by the appended claims.

The invention claimed is:

1. A fluid flow stabilizer for use in a flow of fluid in a conduit between a turbulence creating device and a fluid control device, comprising:

a fluid conduit section having a first end, including a first flange, for mounting said first end to said fluid conduit and a second end, including a second flange, for mounting said second end to said fluid conduit, said fluid conduit section having a length defined between said first flange and said second flange, an internal diameter, and a fluid passage therethrough to allow said fluid to flow from said first end to said second end, a flow straightening device positioned in said fluid conduit section, wherein at least a portion of said flow straightening device has a diameter less than said internal diameter of said fluid conduit section, and further wherein said flow straightening device comprises one or more longitudinally extending vanes, wherein radially outer edges of said vanes contact one of said first and second flanges, but are separated from said internal diameter of a remainder of said fluid conduit section, such that a space is defined therebetween;

said fluid conduit section being constructed of a flexible material to absorb at least one of shock, vibration and mis-alignment in said conduit.

2. The fluid flow stabilizer of claim 1, wherein said fluid conduit section comprises a flexible metal hose.

3. The fluid flow stabilizer of claim 1, wherein said fluid conduit section comprises an elastomeric material.

4. The fluid flow stabilizer of claim 1, wherein said length of said fluid conduit section is less than five times said internal diameter.

5. A pipe flow stabilizer for use in a pipeline between a turbulence creating device and a fluid control device, comprising:

a fluid conduit section having a first end, including a first flange, with a mounting arrangement for mounting said first end to said pipeline and a second end, including a second flange, with a mounting arrangement for mounting said second end to said pipeline, said fluid conduit section having a length, an internal diameter, and a fluid passage therethrough to allow fluid to flow from said first end to said second end, a flow straightening device in said fluid conduit section, wherein at least a portion of said flow straightening device has a diameter less than said internal diameter of said fluid conduit and further wherein said flow straightening device comprises at least four vanes, with each vane arranged perpendicular to adjacent vanes, and wherein radially outer edges of said vanes contact one of said first and second flanges, but are separated from said internal diameter of a remainder of said fluid conduit section, such that a space is defined therebetween;

said fluid conduit section being constructed of a flexible material to absorb at least one of shock, vibration and mis-alignment in said pipeline.

6. The pipe flow stabilizer of claim 5, wherein said turbulence creating device is a pump and said mounting arrangement at said first end is configured to mount directly to an outlet of said pump.

7. The pipe flow stabilizer of claim 5, wherein said fluid control device comprises a valve and said mounting arrangement at said second end is configured to mount directly to an inlet of said valve.

8. The pipe flow stabilizer of claim 5, wherein said conduit comprises a flexible metal hose.

9. The pipe flow stabilizer of claim 5, wherein said conduit comprises an elastomeric material.

10. The pipe flow stabilizer of claim 5, wherein said vanes are contained entirely within the length of said fluid conduit.

11. The pipe flow stabilizer of claim 5, wherein said vanes have a hydrodynamic shape including at least one curve.

12. The pipe flow stabilizer in claim 5, wherein at least one of said first mounting arrangement and said second mounting arrangement comprises a flange with a series of spaced bolt holes extending therethrough.

13. The pipe flow stabilizer of claim 5, wherein said length of said fluid conduit is less than five times said internal diameter.

14. A fluid flow stabilizer for use in a flow of fluid in a conduit between a turbulence creating device and a fluid control device, comprising:

a fluid conduit section having a first end, including a first mounting arrangement portion for mounting said first end to said fluid conduit, and a second end, including a second mounting arrangement portion for mounting said second end to said fluid conduit, said fluid conduit section having a length defined between said first mounting arrangement portion and said second mounting arrangement portion, an internal diameter, and a fluid passage therethrough to allow said fluid to flow from said first end to said second end, a flow straightening device positioned in said fluid conduit section, wherein at least a portion of said flow straightening device has a diameter less than said internal diameter of said fluid conduit section, and further wherein said flow straightening device comprises one or more longitudinally extending vanes, wherein radially outer edges of said vanes contact one of said first and second mounting arrangement portions, but are separated from said internal diameter of a remainder of said fluid conduit section, such that a space is defined therebetween;

said fluid conduit being constructed of a flexible material to absorb at least one of shock, vibration and mis-alignment in said conduit.

15. The fluid flow stabilizer of claim 14, wherein at least one of said first and second mounting arrangement portions includes a flange.

16. The fluid flow stabilizer of claim 14, wherein at least one of said first and second mounting arrangement portions includes a threaded portion.

17. The fluid flow stabilizer of claim 14, wherein at least one of said first and second mounting arrangement portions includes a slip fit arrangement.

18. The fluid flow stabilizer of claim 14, wherein at least one of said first and second mounting arrangement portions includes a compression fitting.

19. A pipe flow stabilizer for use in a pipeline between a turbulence creating device and a fluid control device, comprising:

a fluid conduit section having a first end, including a first mounting arrangement portion with a mounting arrangement for mounting said first end to said pipeline, and a second end, including a second mounting arrangement portion with a mounting arrangement for mounting said second end to said pipeline, said fluid conduit section having a length, an internal diameter, and a fluid passage therethrough to allow fluid to flow from said first end to said second end, a flow straightening device in said fluid conduit section, wherein at least a portion of said flow straightening device has a diameter less than said internal diameter of said fluid conduit and further wherein said flow straightening device comprises at least four vanes, with each vane arranged perpendicular to adjacent vanes, and wherein radially outer edges of said vanes contact one of said first and second mounting arrangement portions, but are separated from said internal diameter of a remainder of said fluid conduit section, such that a space is defined therebetween;

said fluid conduit section being constructed of a flexible material to absorb at least one of shock, vibration and mis-alignment in said pipeline.

20. The pipe flow stabilizer of claim 19, wherein at least one of said first and second mounting arrangement portions includes a flange.

21. The pipe flow stabilizer of claim 19, wherein at least one of said first and second mounting arrangement portions includes a threaded portion.

22. The pipe flow stabilizer of claim 19, wherein at least one of said first and second mounting arrangement portions includes a slip fit arrangement.

23. The pipe flow stabilizer of claim 19, wherein at least one of said first and second mounting arrangement portions includes a compression fitting.

* * * * *